US006676511B2

(12) United States Patent
Payne et al.

(10) Patent No.: US 6,676,511 B2
(45) **Date of Patent: *Jan. 13, 2004**

(54) NON-RECTANGULAR AND/OR NON-ORTHOGONAL ARRANGEMENT OF GAMBLING ELEMENTS IN A GAMING APPARATUS

(75) Inventors: Tony Payne, San Francisco, CA (US); Mark C. Nicely, San Francisco, CA (US)

(73) Assignee: Silicon Gaming-Nevada, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/866,186

(22) Filed: May 25, 2001

(65) Prior Publication Data

US 2001/0036856 A1 Nov. 1, 2001

Related U.S. Application Data

(63) Continuation of application No. 09/397,447, filed on Sep. 16, 1999, now Pat. No. 6,241,607.
(60) Provisional application No. 60/100,612, filed on Sep. 16, 1998.

(51) Int. Cl.[7] ..... A63F 9/24
(52) U.S. Cl. ..... 463/20; 463/21; 273/143 R
(58) Field of Search ..... 463/1, 9–13, 16, 463/20, 21, 23, 25, 30, 36, 37; 273/138.2, 139, 292.293, 143 R

(56) References Cited

U.S. PATENT DOCUMENTS 4,198,052 A 4/1980 Gauselmann ..... 273/143 R
4,365,810 A * 12/1982 Richardson
4,661,906 A * 4/1987 DiFrancesco
5,413,342 A 5/1995 Kaplan ..... 273/143 B
5,580,053 A 12/1996 Crouch ..... 463/20
5,609,524 A * 3/1997 Inoue
5,611,535 A 3/1997 Tiberio ..... 273/143 R
5,697,843 A * 12/1997 Manship
5,704,835 A 1/1998 Dietz, II ..... 463/20
5,807,172 A 9/1998 Piechowiak ..... 463/20
5,851,148 A 12/1998 Brune et al. ..... 463/25
6,004,208 A 12/1999 Takemoto ..... 463/20
6,220,959 B1 4/2001 Holmes, Jr. et al. ..... 463/13
6,241,607 B1 * 6/2001 Payne et al. ..... 463/20
6,322,445 B1 11/2001 Miller ..... 463/13

FOREIGN PATENT DOCUMENTS

WO 95/08799 3/1996

OTHER PUBLICATIONS

European Search Report for European Application No. 99/21514 dated Oct. 10, 2002.

* cited by examiner

*Primary Examiner*—Mark Sager
(74) *Attorney, Agent, or Firm*—Marshall, Gerstein & Borun LLP

(57) ABSTRACT

An improved multiple payline gaming method and apparatus wherein a multiplicity of independently driven symbol carrying elements are arranged in a non-orthogonal and/or non-rectangular array and are combined with a plurality of individually selectable paylines intersecting various combination of the elements so as to give a game player various degrees of latitude in choosing potential outcomes available as a result of each gaming proposition. Means may also be provided for allowing selection of special payout opportunities based upon certain positional relationships between various ones of the elements and their displayed symbols.

18 Claims, 6 Drawing Sheets

NON-RECTANGULAR AND/OR NON-ORTHOGONAL ARRANGEMENT OF GAMBLING ELEMENTS IN A GAMING APPARATUS

RELATED APPLICATIONS

This is a continuation of U.S. application Ser. No. 09/397,447, filed Sep. 16, 1999, now U.S. Pat. No. 6,241,607, the disclosure of which is incorporated by reference herein in its entirety, which claims the benefit of U.S. Provisional Application No. 60/100,612, filed Sep. 16, 1998, entitled "Non-Rectangular And Non-Orthogonal Arrangement Of Gambling Elements."

FIELD OF THE INVENTION

This invention relates generally to gaming methods and apparatus of the slot machine type, and more particularly, to an improved multiple payline gaming method and apparatus wherein a multiplicity of independently driven symbol carrying elements are arranged in a non-orthogonal and/or non-rectangular array and are combined with a plurality of individually selectable paylines intersecting various combination of the elements so as to give a game player various degrees of latitude in choosing potential outcomes available as a result of each gaming proposition. Means may also be provided for allowing selection of special payout opportunities based upon certain positional relationships between various ones of the elements and their displayed symbols.

BACKGROUND OF THE INVENTION

In typical multiple payline gaming devices such as the slot machines found in many casinos throughout the world, a play field, face plate, video screen or other display means including a plurality of three, four or five reels, or other rotating objects or images thereto is often provided for either real or virtual spin operation. Each such object contains at least one symbol which, upon stoppage of the object's rotation, may align with one or more horizontally or diagonally extending paylines. The symbols aligned along a particular payline, when compared to a pay table, then determine the result of a gambling proposition. For example, if the gaming device is a three reel apparatus wherein, upon stopping of its rotation, each reel reveals three play symbols at a time, the device may contain up to three horizontal paylines and two diagonal paylines where each payline encompasses or extends across three play symbols at a time; i.e., one symbol or space therefor on each reel. Such an array is illustrated in FIG. 1 of the drawing and includes three reels 10–14 of a type usually positioned behind a real or virtual face plate 16 having windows or sets of windows 18–22 for revealing one or more reel carried symbols on each reel. The reels are independently driven and stopped at random positions by a reel drive system 23. The face plate 16 is also inscribed with 3 horizontal paylines 24–28 and 2 diagonal paylines 30 and 32. Note that each payline crosses a window or symbol location (or space therefor) on each reel. Although arguably such apparatus could also include additional diagonal paylines, crossing only two of the reels, no such payline configuration is known to exist. Note that in the illustrated arrangement, it would not be feasible to have vertical paylines, even though three play symbol locations would lie beneath the intersected windows, because the relationship between the three adjacent symbols on each reel is fixed and clearly not a random organization of elements.

Games of the illustrated type do not provide the player with play choices other than that directly associated with the number of coins or credits wagered. Since many players would enjoy the opportunity to make multiple wagers per play proposition, it will be appreciated that the prior art arrangement of reels, play symbols and paylines is rather limiting. There is therefore a need to provide a gaming element arrangement in which substantially more choice is given to the player in terms of selection of paylines and play volatility. This would be advantageous to the player in that his perceived chances of winning would be enhanced. At the same time, such an arrangement would be beneficial to the game proprietor in that it would tend to increase the number of wagers made by a player per play proposition.

SUMMARY OF THE INVENTION

In one aspect, the invention is directed to a gaming apparatus comprising: a play screen that displays an arrangement of a plurality of gaming symbols at a plurality of locations along a payline, the locations being arranged in a non-orthogonal array; a player input interface; a comparison device that determines an award based on the arrangement of the gaming symbols displayed along the payline; and a plurality of individually selectable paylines, each of the paylines intersecting a different combination of the locations, whereby depending upon selection of one or more of the paylines, a player can influence the probability of a payout per gaming proposition.

IN THE DRAWINGS

Figure 1:
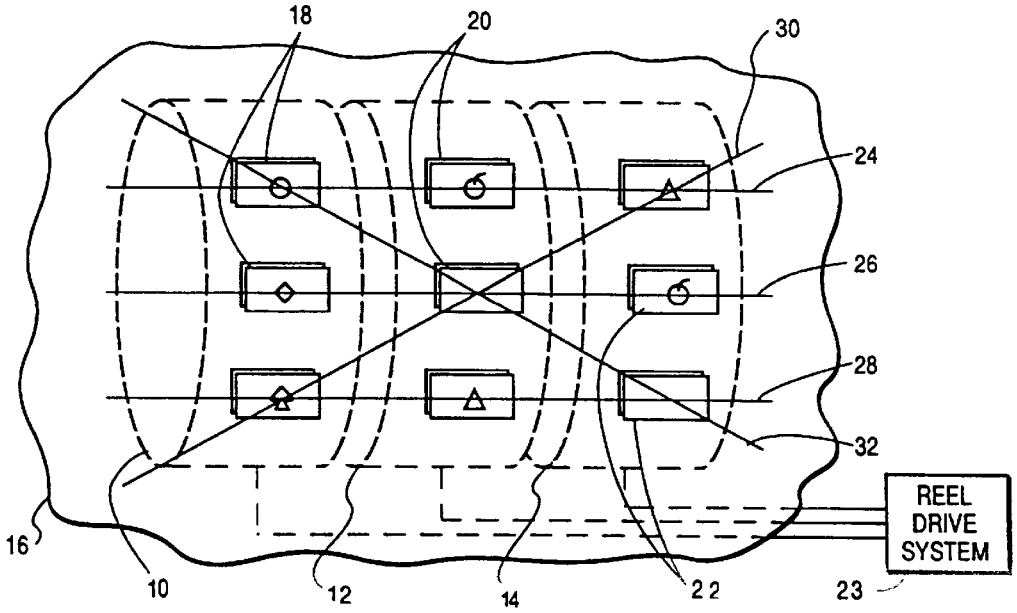
Fig. 1 (PRIOR ART)
FIG. 1 is a depiction of a prior art three-reel game having multiple paylines, each of which crosses one of the three elements of each reel.
Figure 2:
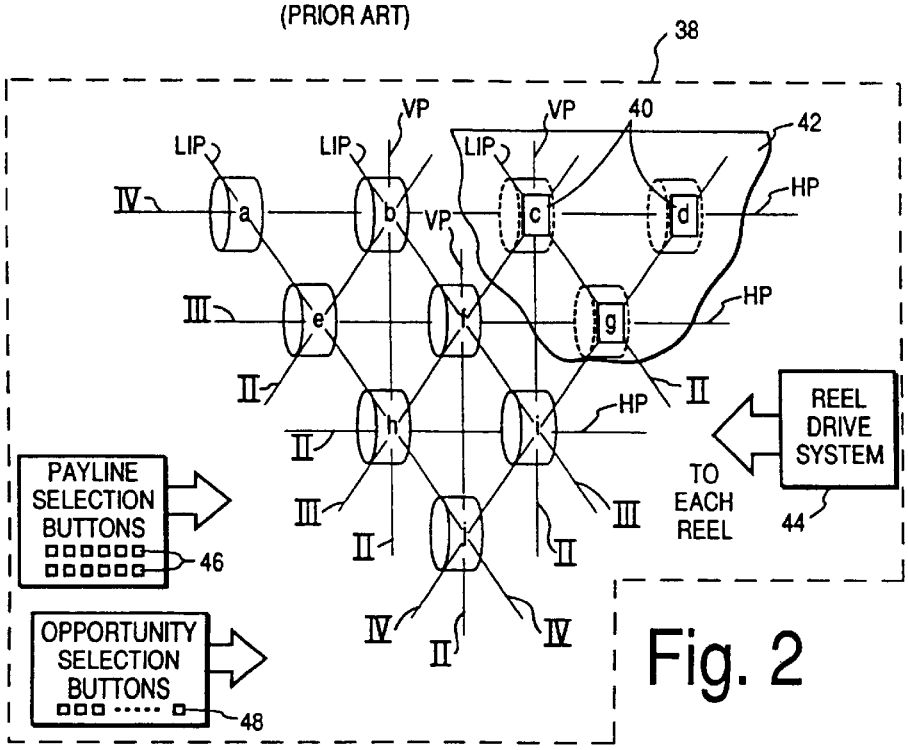
FIG. 2 is a schematic depiction of a ten-reel embodiment of a multiple reel, multiple payline game with the reels arranged in a triangular array in accordance with the present invention.
Figure 2A:
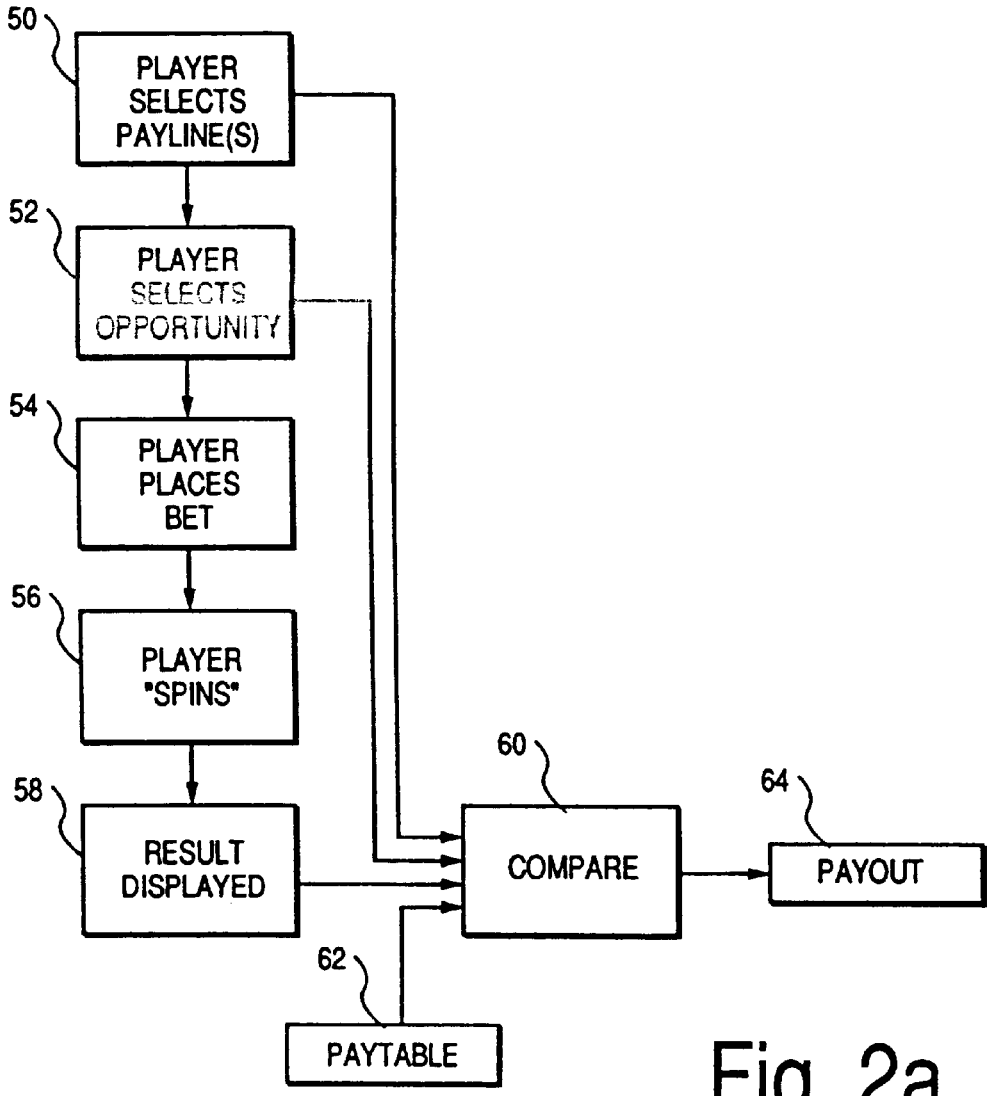
Figure 3:
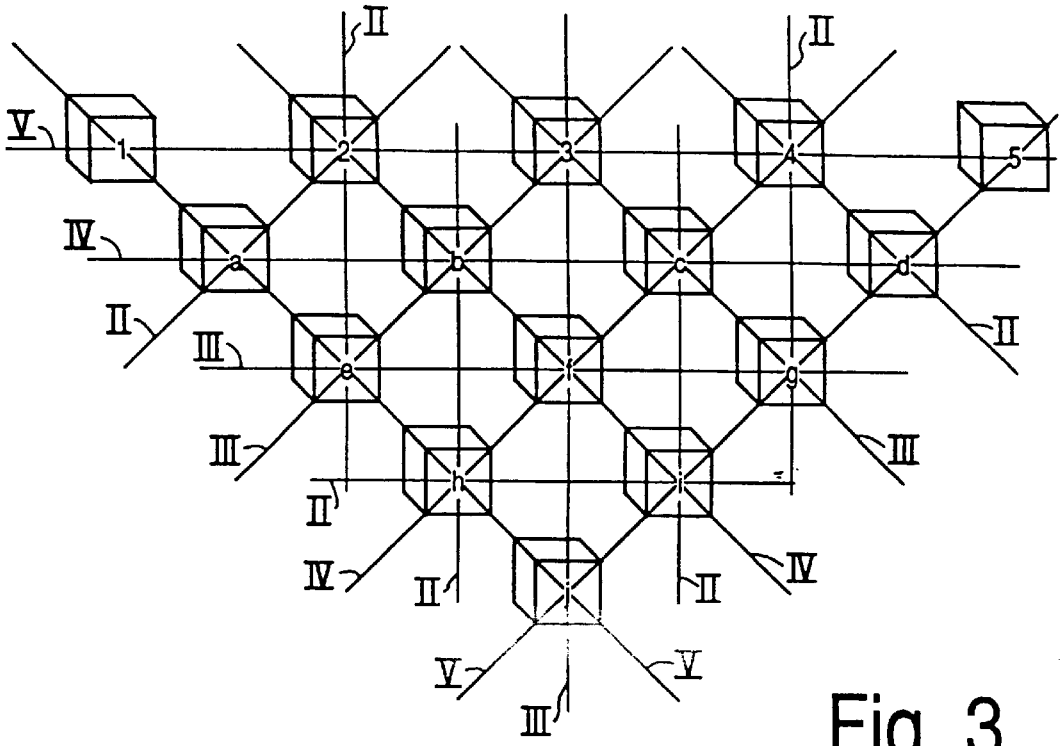
Figure 4:
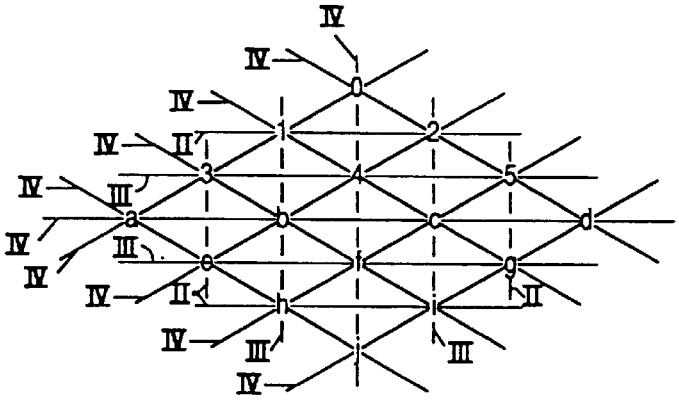

FIG. 2*a* is a block diagram illustrating a method of operation in accordance with the present invention;

FIG. 3 illustrates a 15-element of a multiple element, multiple payline gaming embodiment organized in a triangular array in accordance with the present invention;

FIG. 4 illustrates a 16-element embodiment of a multiple element, multiple payline game organized in a diamond shape in accordance with the present invention; and FIGS. 5–9 illustrate further alternative embodiments of multiple element, multiple payline gaming layouts in accordance with the present invention.

DETAILED DESCRIPTION OF THE PREFERRED EMBODIMENTS

Turning now to FIG. 2 of the drawing, a multiple element, multiple payline gaming field or screen is schematically depicted at 38 to include 10 reels or other rotatable or otherwise changeable gaming elements designated 1-j, each having at least one gaming symbol, or a blank space in place thereof, revealed one at a time, or through a play window 40 perhaps formed in a real or virtual "cover plate" 42. Hereinafter it will be understood that when the term "element" is used, it means any type of gaming element, such as for example, spinning reels, playing cards, dice, dominoes, etc., having the capability of displaying one or more gaming symbols (or the lack thereof) per element, displayable one at a time. Each of the reels are independently and randomly driven by a reel drive system 44 so that all combinations of symbols revealed in the several windows are likewise random in occurrence. This non-orthogonal, non-rectangular, triangular array of elements includes three horizontal paylines "HP", three leftwardly inclined paylines "LIP", and three rightwardly inclined paylines "RIP" all respectively, intersecting four, three and two sets of adjacent windows, and three vertical paylines "VP", each intersecting two non-adjacent windows separated by a horizontal row of elements. This arrangement is unique in that it can include up to twelve multi-symbol paylines designated II, III and IV having between two and four symbols per payline. For example, the illustrated field is comprised of three paylines IV including the four symbols: a-j, j-d, a-d; three 3 symbol paylines III including: bfi, hfc and efg; and 6 two symbol paylines II including: be, bh, fj, ci, cg and hi. Appropriate buttons 46, or other suitable player input means are provided to accommodate the payline selection. A game such as this might be organized to pay the player awards listed on a paytable (not shown) setting fourth certain combinations of symbols indicating winning combinations when such combinations are aligned along particular player selected paylines. For example, there could be various types of awards for obtaining 1) 4 matching symbols on up to four selectable symbol paylines IV;

2) 3 matching symbols on up to three selectable symbol paylines III;

3) 3 contiguous matching symbols on any selectable four symbol payline IV;

4) 2 contiguous matching symbols on any selectable three III or four IV symbol paylines (wherein one of the symbols could be required to be at the edge of a payline);

5) 1 contiguous matching symbol on selected adjacent three III or four IV symbol paylines (where one of the symbols could be required to be at the edge of a payline); and 6) 2 matching symbols on selected two symbol paylines II.

This game could also offer the following kinds of propositions:

a) Player places one wager on the entire game, i.e., covering all available paylines.

b) Player places wagers on only selected paylines. Since different paylines offer different payout opportunities (based on whether the payline covers 2, 3 or 4 symbols), this allows the player to structure his wager according to the selected payout opportunities.

c) Player places wagers on different kinds of outcome opportunities. For example, he can place independent wagers for any of the outcome types 1, 2, 3, 4, 5 or 6 listed above by selecting control inputs in the form of additional outcome opportunity buttons 48 that are provided in addition to the payline selection buttons 46.

It will thus be appreciated that the present invention is a substantial departure from the prior art multiple payline games wherein the paylines are only selected as a direct result of the number of coins or credits wagered. In contrast, this invention allows not only individual selection of one or more particular paylines, it also permits the player to select various payout opportunities (outcome types).

By way of example, a possible play scenario in accordance with the present invention is depicted in FIG. 2*a*. As suggested by block 50 of this diagram, the player would first select paylines to be included in his wager. If he chooses, he can also select a particular outcome opportunity level (block 52) or play at a default level. He then places his bet (block 54) by inserting coins or other means of payment, or attributes credits, followed by the activation of a "spin" button, handle pull or other input command (block 56). The reel drive system of the gaming device will then individually and independently "drive" each of the several gaming elements to new display states that will collectively represent a new random output display (block 58). A results comparator 60 then compares the states of the displayed elements in the selected paylines to a paytable and determines a corresponding payout (block 64) adjusted to reflect any selected opportunity level inputs.

In FIG. 3, a 15-element field is illustrated, again having a non-orthogonal, non-rectangular, triangular array configuration. In this embodiment, the gaming elements 1-j are shown as being comprised of multiple die having a plurality of faces, each of which includes a different symbol. The horizontal, vertical and inclined paylines can include:

up to three five symbol paylines V: 1-j, 1-5, j-5;

up to three four symbol paylines IV: 2-i, h-4, a-d;

up to four three symbol paylines III: eb3, 3*fj*, 3*cg*, eft; and up to seven two symbol paylines II: 2*a*, 4*d*, hi, bh, ze, 4*j*, ci.

This game could include the same kind of proposition opportunities as in the ten reel game of FIG. 2 with additional extensions to support for example, 3, 4 and 5 contiguous matching symbols on a 5-symbol line; 2, 3 and 4 contiguous matching symbols on a 4 symbol line; etc.

FIG. 4 schematically illustrates a 16-element "diamond" shaped configuration including elements 0-j. This combination offers:

up to 10 paylines IV of 4 symbols each: 0-j, 3-i, 1-g, 0-d, a-0, e-2, h-5, j-d, a-j, a-d;

up to four paylines III of 3 symbols: 1*b*, hb, 2*ci,* 345, efg; and up to four paylines II of 2 symbols: 12, hi, 3*e,* 5*g*.

Note that not all of these paylines need to be offered for this arrangement to be innovative.

Figure 5:
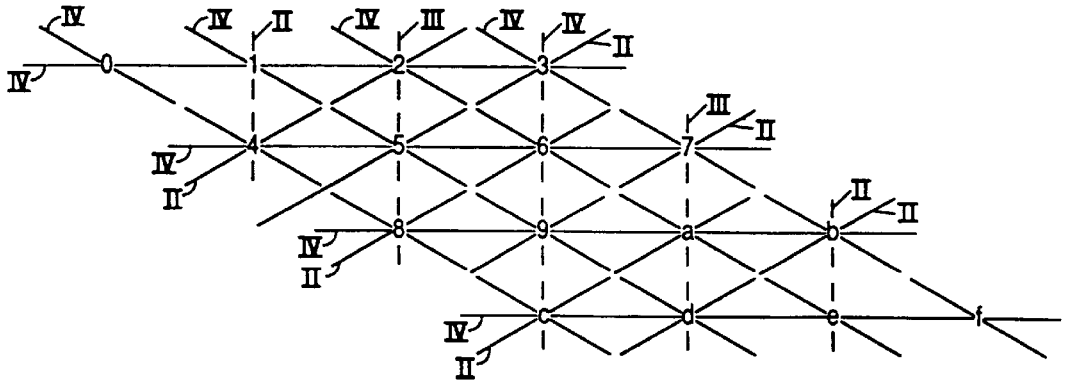

In FIG. 5, a skewed parallelogramic array of 16 elements 0-f is illustrated which provides for:

up to 9 four element paylines IV: 0-3, 4-7, 8-b, c-f, 0-c, 1-d, 2-e, 3-f, and 3-c;

up to 2 three element paylines III: 2-8 and 7-d; and up to 8 two element paylines 11: 1-4, 2-4, 3-5, 6-8, 7-9, a-c, b-d and b-e.

Figure 6:
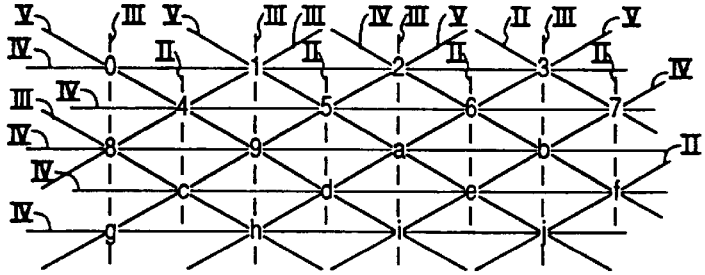

FIG. 6 illustrates a 20-element laterally offset line array, including elements 0-j, which provides payline possibilities of:

up to 4 five symbol paylines IV: 0-i, l-j, g-2, h-3;

up to 7 four symbol paylines IV: 0-3, 4-7, 8-b, c-f, g-j, i-7 and 2-f; and up to 4 two symbol paylines II: 4-c, 5-d, 6-e and 7-f.

Figure 7:
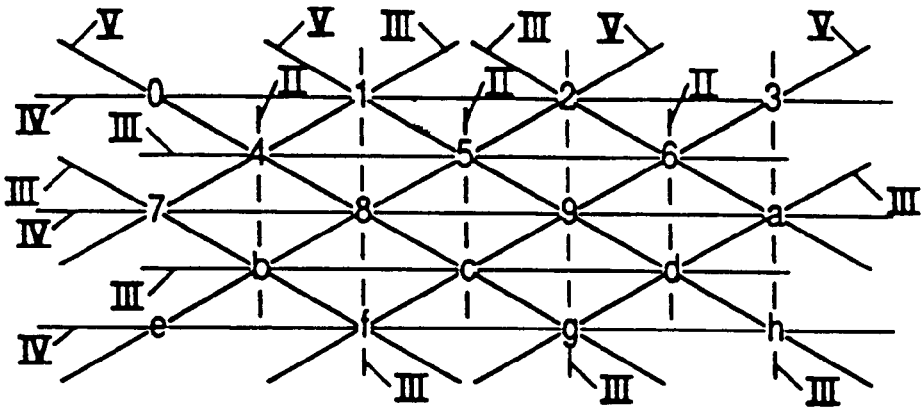

In FIG. 7 an 18-element array is depicted including elements 0-h and comprised of alternating horizontal lines of 4 and 3 elements, which includes up to 4 five symbol paylines V: 0-g, 1-h, e-2 and f-3;

up to 3 four element symbol paylines IV: 0-3, 7-a and e-h;

up to 10 three element paylines III: 4-6, b-d, 7-f, 2-a, 0-e, 1-f, 2-g, 3-h, 7-1 and g-a; and up to 3 two symbol paylines II: 4-b, 5-c and 6-d.

Figure 8:
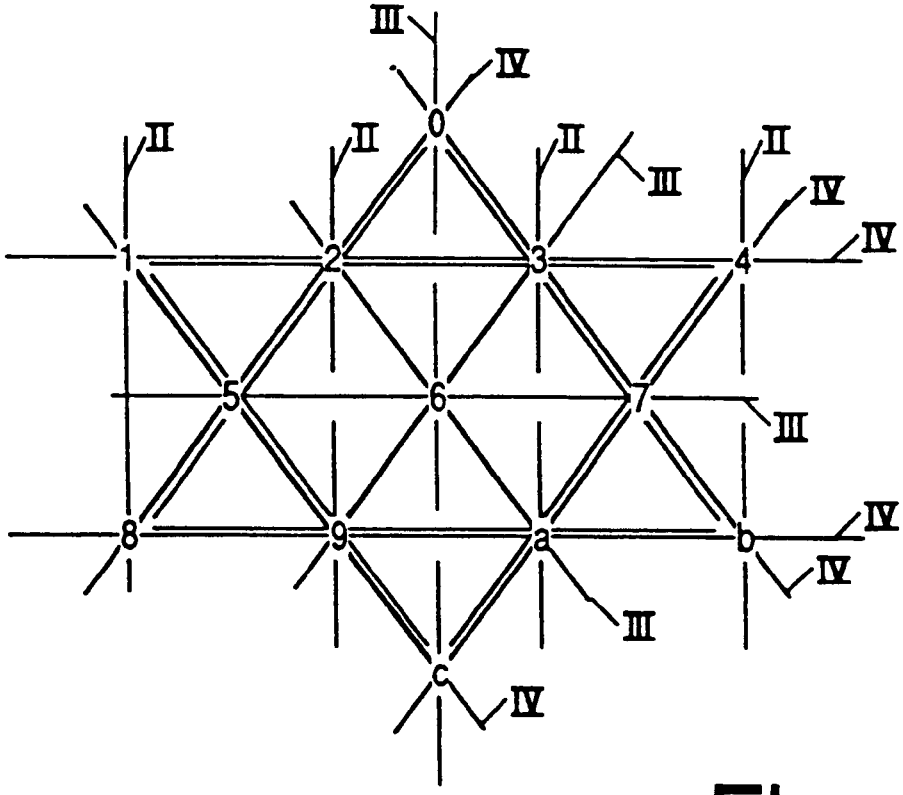

In FIG. 8 a 13-element "star-configured" array is depicted including elements 0-c, which provides for:

up to 6 four element paylines IV: 1-4, 1-c, c-4, 0-8, 0-b and 8-b;

up to 6 three element paylines III: 8-4, 1-b, 0-c, 4-8, 5-7, 2-a and 3-9; and up to 4 two element paylines II: 2-9, 3-a, 5-a and 2-7.

Note that in this embodiment the element "6" could be treated as a "wild card" or special purpose element which might carry a special bonus weighting or be separately selectable as a special "opportunity element."

Figure 9:
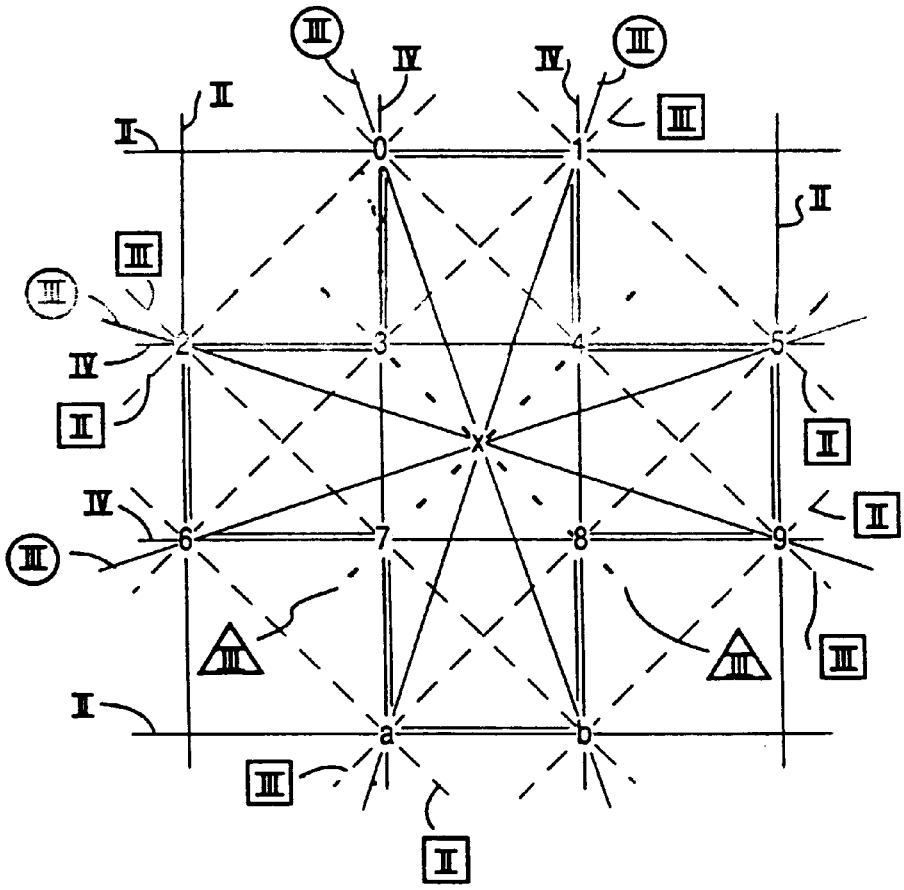

In FIG. 9 a nine element "cross" shaped configuration is depicted including the elements 0-b plus an extra center positioned element "X" that could be used as a bonus element. The various combinations of this configuration are labeled as multiple "layers" of elemental paylines wherein II, III and IV illustrate vertical and horizontal payline combinations; paylines designated by the encircled III's represent diagonal paylines passing through the center point X; the triangularly encompassed paylines III represent additional diagonal paylines passing through the center element X, and rectangularly circumscribed II's and III's represent other possible diagonal paylines not passing through "X".

It will of course be appreciated that still other arrangements and variations including triangle versus diamond versus irregular rectangular versus cross versus snowflake versus pentagon, configuration, etc., may also be used in accordance with the present invention Moreover, the orientation of the arrays may be varied. For example, the direction of pointing of a triangular array might have a special significance. In addition, geometric figures formed by intersecting lines of the arrays could be emphasized and telescopically nested such that an outer ring of intersecting paylines might have one significance, where an encircled inner ring of intersecting paylines would have another significance. Moreover, the use of paylines of differing lengths could have a significance versus use of paylines of the same length in certain configurations.

This invention thus provides a novel gambling array and payline selection method and apparatus in which numerous choices of play propositions are presented to the player either alone or in combination with a scheme of win frequency/probability, selections that makes the game much more interesting.

Although the present invention has been described above in terms of several alternative embodiments, it is to be understood that such illustrations are not considered to be exhaustive. It is however intended that the following claims be broadly interpreted as covering all alterations, variations, extensions and alternatives as fall within the true spirit and scope of the invention.

What is claimed is:

1. A gaming apparatus comprising:

a play screen that displays an arrangement of a plurality of gaming symbols at a plurality of locations along a payline, said locations being arranged in a non-orthogonal array;

a player input interface;

a comparison device that determines an award based on said arrangement of said gaming symbols displayed along said payline; and a plurality of individually selectable paylines, each of said paylines intersecting a different combination of said locations, whereby depending upon selection of one or more of said paylines, a player can influence the probability of a payout per gaming proposition, wherein said non-orthogonal array includes a plurality of horizontally extending paylines intersecting equal numbers of locations arranged in alternating rows, horizontally offset relative to adjacent rows.

2. A gaming apparatus as recited in claim 1 wherein said array further includes vertically extending paylines, alternating ones of which intersect equal numbers of locations disposed in said horizontal paylines.

3. A gaming apparatus as recited in claim 1 and further including inclined paylines angularly intersecting locations contained in adjacent ones of said horizontally and vertically extending paylines.

4. A gaming apparatus comprising:

a play screen that displays an arrangement of a plurality of gaming symbols at a plurality of locations that are arranged in a non-orthogonal array;

a player input interface;

a device that determines an award based on said arrangement of said gaming symbols displayed; and a plurality of individually selectable paylines, each of said paylines intersecting a different combination of said locations, wherein said non-orthogonal array includes a plurality of horizontally extending paylines intersecting equal numbers of locations arranged in alternating rows, horizontally offset relative to adjacent rows.

5. A gaming apparatus as recited in claim 4 wherein said non-orthogonal array of locations comprises a triangular array having alternating odd and even numbers of locations disposed along mutually parallel paylines.

6. A gaming apparatus as recited in claim 4, comprising a plurality of inclined paylines angularly intersecting locations contained in adjacent ones of horizontal paylines.

7. A gaming apparatus as recited in claim 4, comprising a plurality of vertical paylines intersecting locations disposed in alternating ones of horizontal paylines.

8. A gaming apparatus as recited in claim 4 wherein said symbols comprise reel symbols, dice symbols, domino symbols or card symbols.

9. A gaming apparatus comprising:

a play screen that displays an arrangement of a plurality of gaming symbols at a plurality of locations that are arranged in a non-orthogonal array, said non-orthogonal array comprising a triangular array;

a player input interface;

a device that determines an award based on said arrangement of said gaming symbols displayed; and a plurality of individually selectable paylines, each of said paylines intersecting a different combination of said locations, said paylines including a first linear payline having a first number of locations and a second linear payline having a second number of locations different than said first number of locations, said first payline being parallel to said second payline.

10. A gaming apparatus as recited in claim 9 wherein said triangular array comprises alternating odd and even numbers of locations disposed along mutually parallel paylines.

11. A gaming apparatus as recited in claim 9, comprising a plurality of inclined paylines angularly intersecting locations contained in adjacent ones of horizontal paylines.

12. A gaming apparatus as recited in claim 9, comprising a plurality of vertical paylines intersecting locations disposed in alternating ones of horizontal paylines.

13. A gaming apparatus as recited in claim 9 wherein said symbols comprise reel symbols, dice symbols, domino symbols or card symbols.

14. A gaming apparatus comprising:

a play screen that displays an arrangement of a plurality of gaming symbols at a plurality of locations that are arranged in a non-orthogonal array comprising a plurality of rows of gaming symbols where each row is horizontally offset from an adjacent row;

a player input interface;

a device that determines an award based on said arrangement of said gaming symbols displayed; and a plurality of individually selectable paylines, each of said paylines intersecting a different combination of said locations, said paylines being selectable so that a plurality of paylines may be selected for a game, said paylines comprising:

a first linear payline extending in a first inclined direction that is neither horizontal nor vertical;

a second linear payline extending in said first inclined direction and parallel to said first payline;

a third linear payline extending in a second inclined direction that is not parallel to said first inclined direction and that is neither horizontal nor vertical; and a fourth linear payline extending in said second inclined direction and parallel to said third payline.

15. A gaming apparatus as recited in claim 14 wherein said non-orthogonal array of locations comprises a triangular array having alternating odd and even numbers of locations disposed along mutually parallel paylines.

16. A gaming apparatus as recited in claim 14, comprising a plurality of inclined paylines angularly intersecting locations contained in adjacent ones of horizontal paylines.

17. A gaming apparatus as recited in claim 14, comprising a plurality of vertical paylines intersecting locations disposed in alternating ones of horizontal paylines.

18. A gaming apparatus as recited in claim 14 wherein said symbols comprise reel symbols, dice symbols, domino symbols or card symbols.

* * * * *